US005829351A

United States Patent [19]

Anderson et al.

[11] Patent Number: 5,829,351

[45] Date of Patent: Nov. 3, 1998

[54] LABELER HAVING STEPPER MOTOR DRIVING PLURAL ELEMENTS

[75] Inventors: David N. Anderson, Auburndale; Wayne C. Sherman, Lakeland, both of Fla.

[73] Assignee: FMC Corporation, Chicago, Ill.

[21] Appl. No.: 863,036

[22] Filed: May 23, 1997

[51] Int. Cl.[6] ..... B65C 9/18; B65C 3/00

[52] U.S. Cl. ..... 101/36; 156/568; 156/542; 156/572; 156/361

[58] Field of Search ..... 101/36, 37, 41, 101/35; 156/568, DIG. 38, 542, 572, 361

[56] References Cited

U.S. PATENT DOCUMENTS

| | | | |
|---|---|---|---|
| 1,085,077 | 1/1914 | Ballard | 83/162 |
| 2,266,087 | 12/1941 | Schlemmer | 216/29 |
| 2,690,104 | 9/1954 | Schwartz et al. | 93/88 |
| 2,765,205 | 10/1956 | Capella et al. | 312/91 |
| 2,933,216 | 4/1960 | Cole | 221/73 |
| 3,158,522 | 11/1964 | Dreher | 156/519 |
| 3,193,430 | 7/1965 | Messmer et al. | 156/355 |
| 3,440,123 | 4/1969 | Hamisch, Sr. | 156/384 |
| 3,611,929 | 10/1971 | Schrotz et al. | 101/362 |
| 3,955,781 | 5/1976 | Schroter et al. | 221/73 |
| 4,123,310 | 10/1978 | Varon et al. | 156/568 |
| 4,156,627 | 5/1979 | Hamisch, Jr. | 156/384 |
| 4,191,608 | 3/1980 | Bussard et al. | 156/584 |
| 4,217,164 | 8/1980 | La Mers | 156/541 |
| 4,253,902 | 3/1981 | Yada | 156/361 |
| 4,303,461 | 12/1981 | La Mers | 156/361 |
| 4,347,094 | 8/1982 | Watanabe | 156/568 |
| 4,454,180 | 6/1984 | La Mers | 428/42.3 |
| 4,547,252 | 10/1985 | La Mers | 156/497 |
| 4,648,930 | 3/1987 | La Mers | 156/247 |
| 4,842,660 | 6/1989 | Voltmer et al. | 156/542 |
| 4,896,793 | 1/1990 | Briggs et al. | 221/73 |
| 5,061,334 | 10/1991 | Paules | 156/542 |
| 5,344,519 | 9/1994 | Galchefski et al. | 156/DIG. 38 |
| 5,387,302 | 2/1995 | Bernard et al. | 156/542 |
| 5,489,360 | 2/1996 | Shimizu et al. | 156/568 |
| 5,645,680 | 7/1997 | Rietheimer | 156/568 |
| 5,660,676 | 8/1997 | Brooks | 156/541 |

FOREIGN PATENT DOCUMENTS 0 113 256 A2 12/1983 European Pat. Off. .

*Primary Examiner*—Edgar S. Burr
*Assistant Examiner*—Leslie Grohusky
*Attorney, Agent, or Firm*—Allen, Dyer, Doppelt, Milbrath & Gilchrist, P.A.

[57] ABSTRACT

An improved labeler includes a housing and a bellows drive gear and cassette drive sprocket spaced apart and each rotatably supported in the housing. A stepper motor is mounted in the housing and has an output shaft. A first drive gear is affixed to the shaft and engages the bellows drive gear. A second drive gear is affixed to the shaft. A drive train is interposed between and engages the second gear and the cassette drive sprocket. The stepper motor is positioned between the bellows drive sprocket and the cassette drive sprocket whereby the footprint of the labeler is minimized.

15 Claims, 9 Drawing Sheets

LABELER HAVING STEPPER MOTOR DRIVING PLURAL ELEMENTS

This invention relates to labelers generally, and more particularly, to labelers for the application of vinyl labels to fruit and vegetables.

Labels are applied to fruit and vegetables in packing houses, where the speed at which the labels are applied, the accuracy of the label application, and the space required by the labeler, i.e. the labeler footprint, are important. Speed is important because the fruit must be packed and shipped quickly so that the shelf life in stores will be as long as possible and the speed of the labeler is the limiting constraint. This constraint of labeler speed also results in inefficient use of other equipment and personnel in the packing house, thus increasing the overall cost of operation. Accuracy, i.e. the successful application of the proper label to the fruit, is important because packing house profitability is adversely affected when a label that would have permitted a higher selling price is not applied to fruit otherwise capable of commanding such higher price. Space is important because of the physical configuration of any given packing house. The fruit is transported in a series of lanes, each lane conveying fruit on a plurality of cradles connected to an endless belt, each cradle supporting and locating an individual fruit. The fruit in each lane is sized by conventional sizing means and subsequently conveyed past a plurality of labelers arranged in series or banks, each of the labelers in the series of labelers being loaded with a different label, i.e. a label imprinted with indicia to identify the size of the fruit. The physical arrangement of the packing house often limits, without major reconstruction of the building, the number of banks of labelers it is possible to install.

The present invention addresses these important considerations, and provides a labeler which is compact, permitting the installation of three banks of labelers in the space normally required by only two banks of prior art labelers, which can be operated at higher speeds, which can apply labels with greater accuracy than prior art labelers even at higher speeds, which requires fewer parts, and which is relatively simple to manufacture and maintain. These and other attributes of the present invention, and many of the attendant advantages thereof, will become more readily apparent from a perusal of the following description and the accompanying drawings, wherein;

Figure 1:
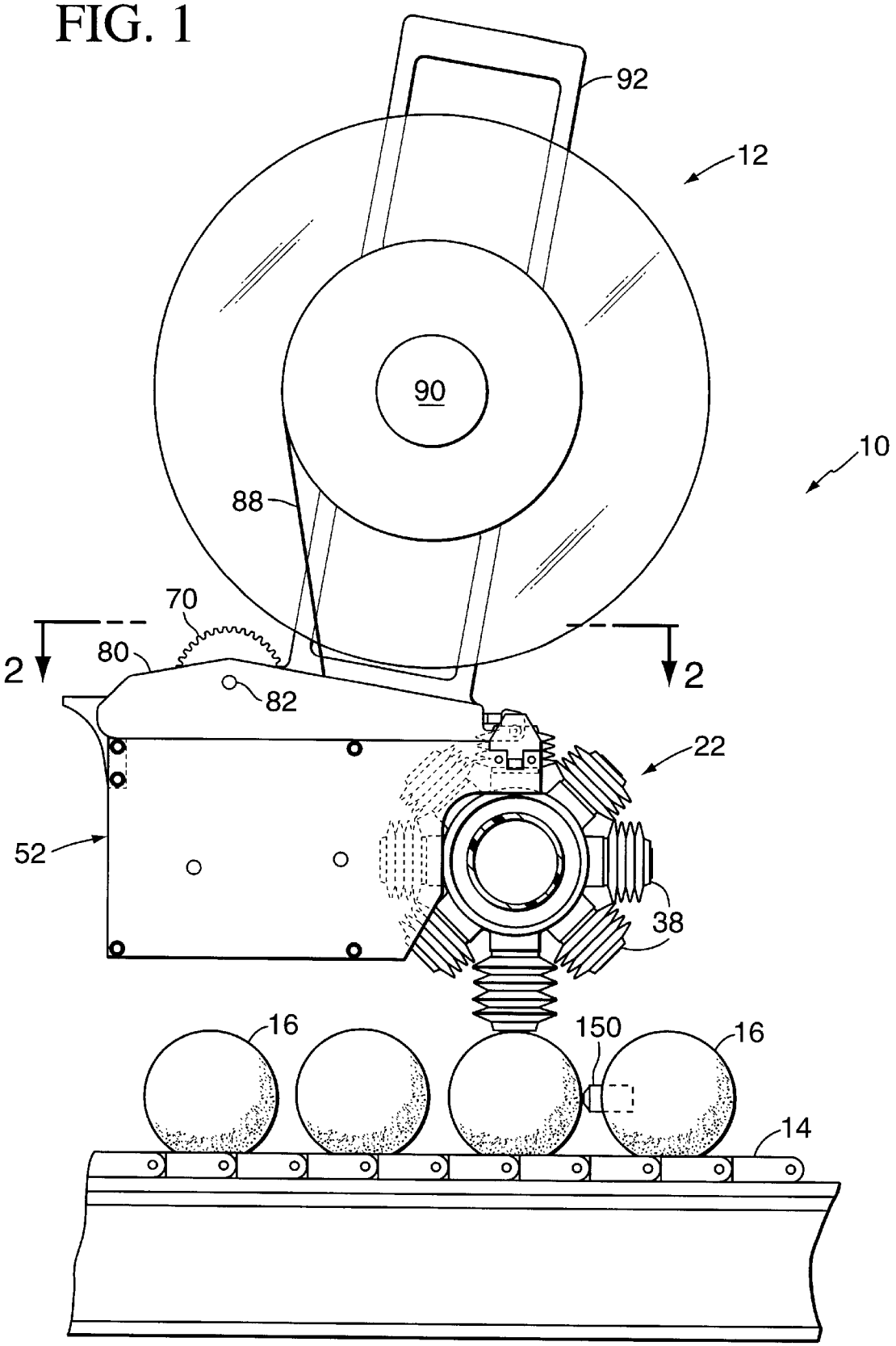
FIG. 1 is a side elevational view of a labeler, with the label cassette installed, according to the present invention.
Figure 2:
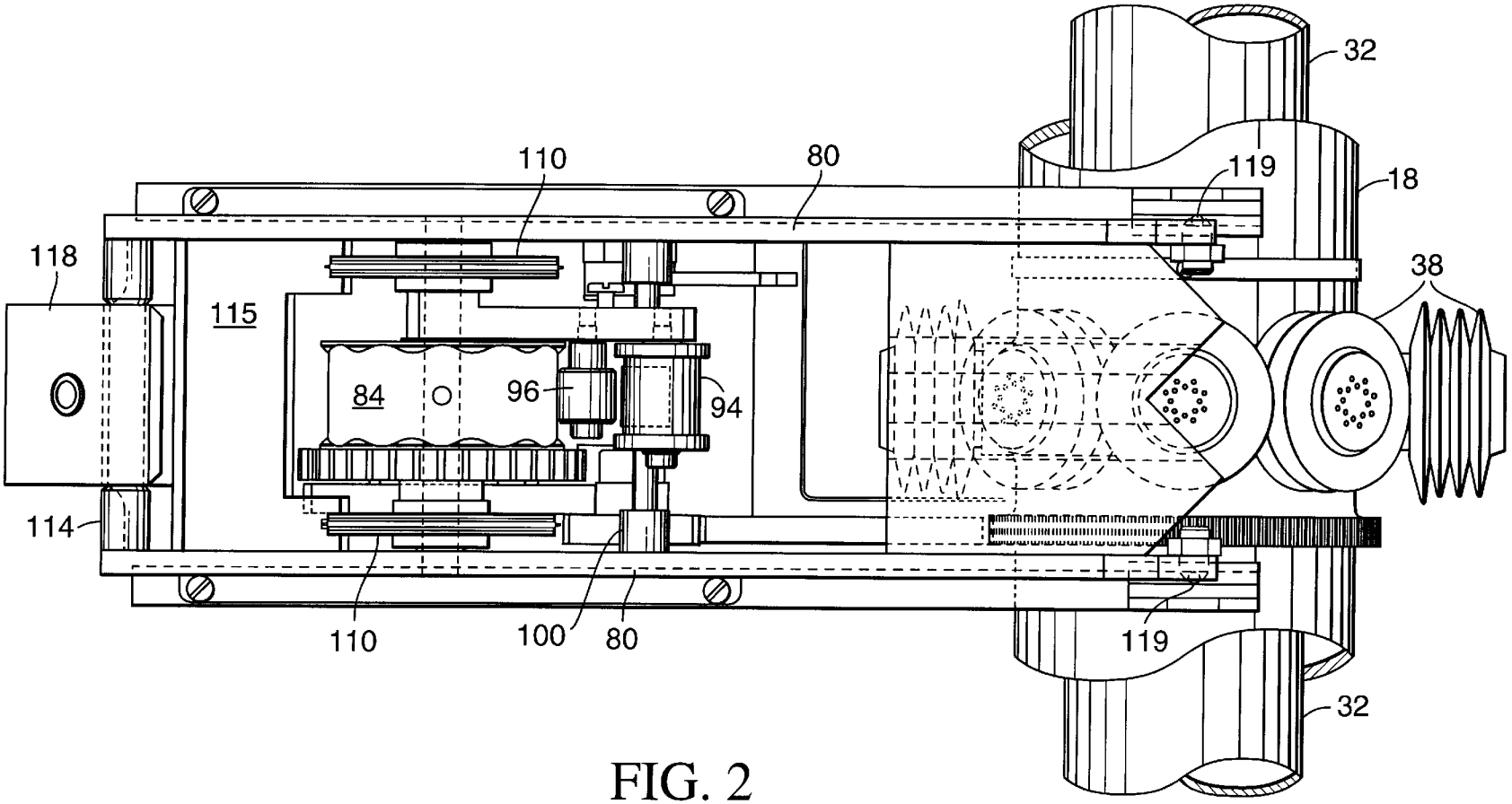
FIG. 2 is a cross sectional view, taken on line 2—2 of FIG. 1.
Figure 5:
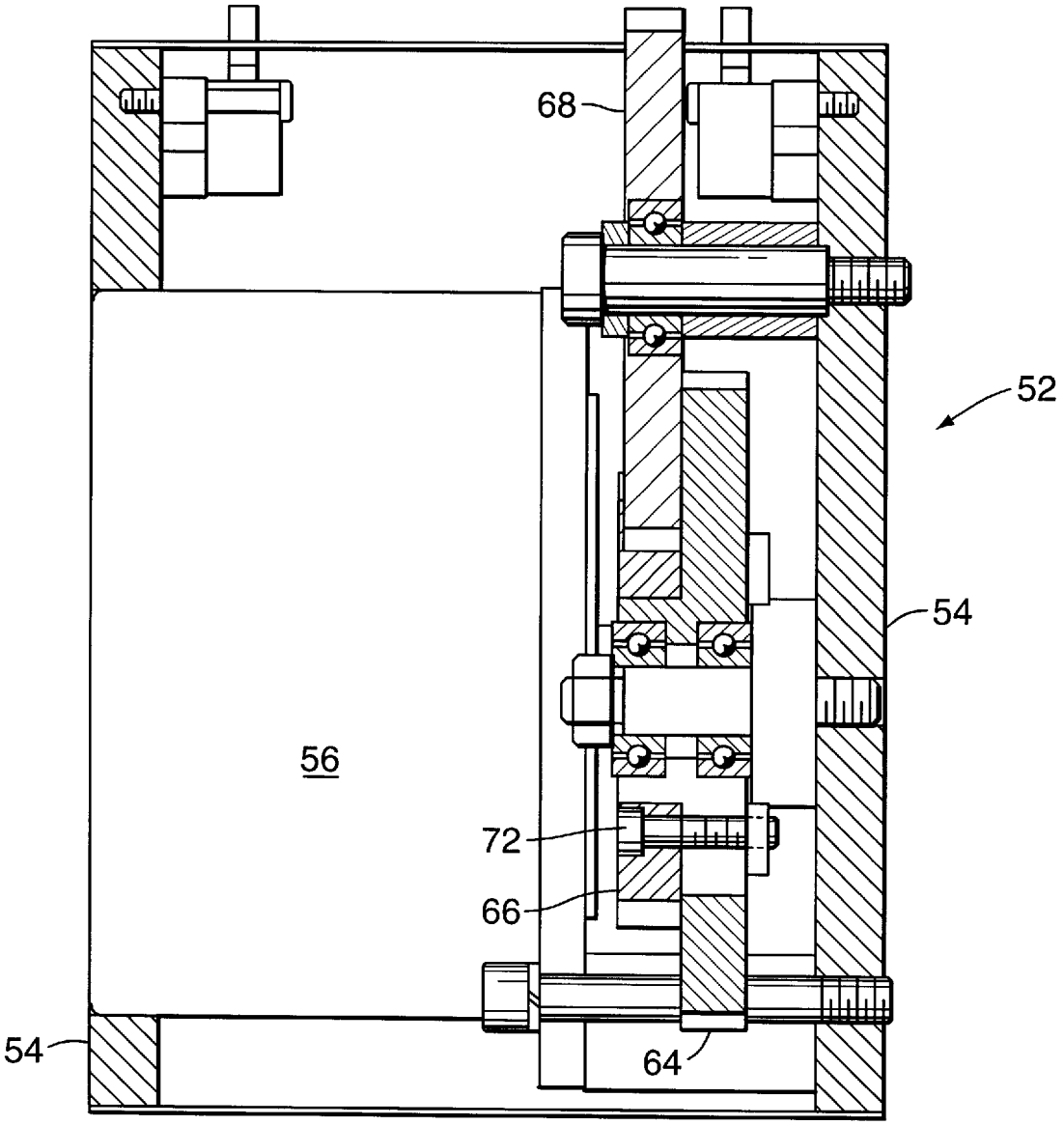
Figure 6:
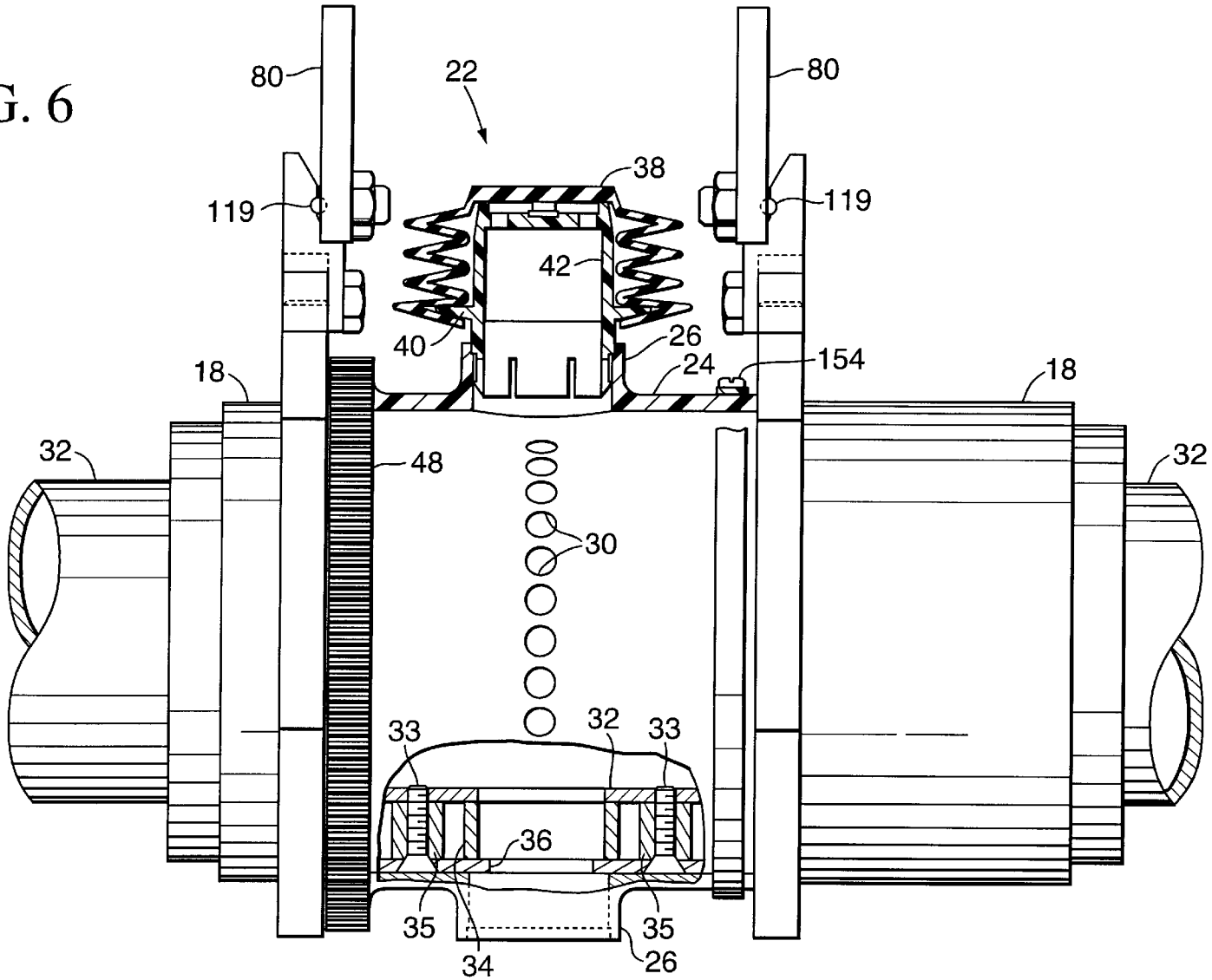
Figure 7:
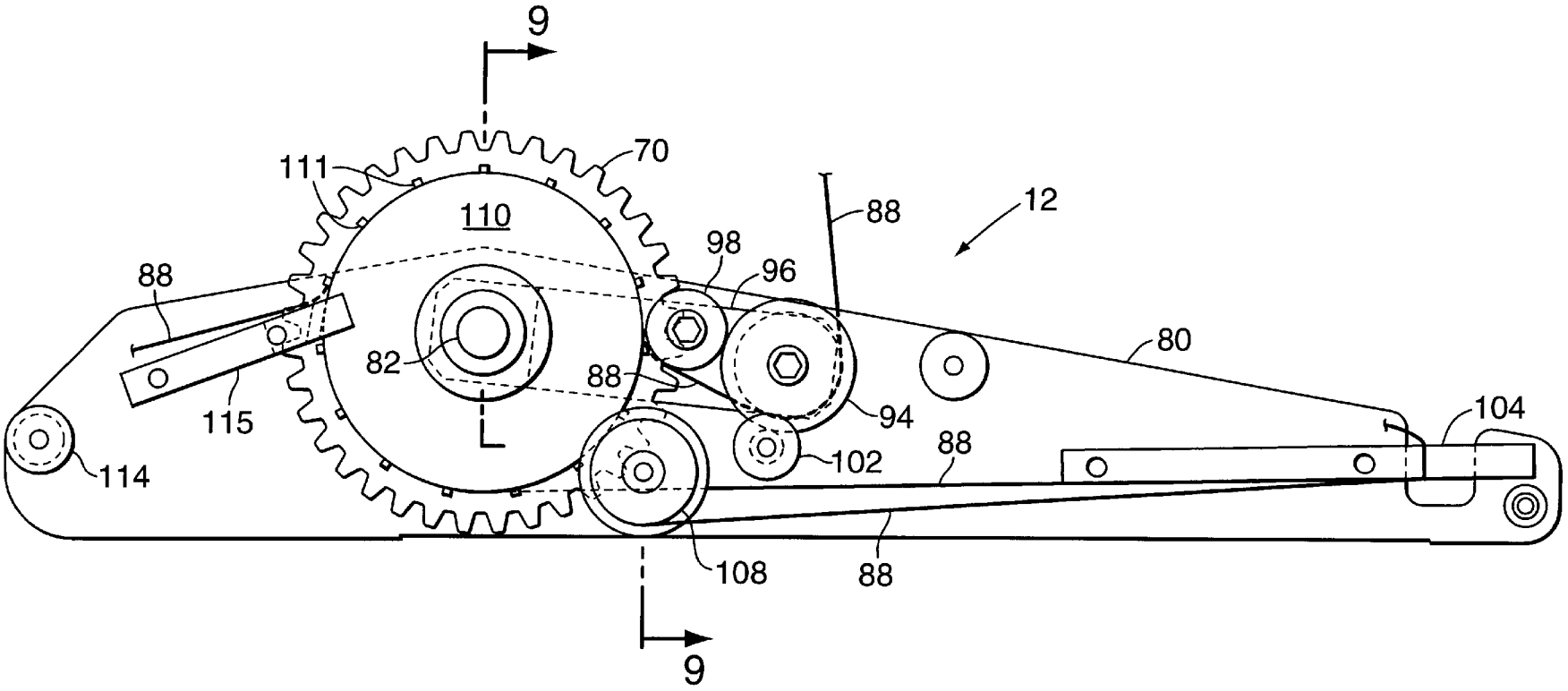
Figure 8:
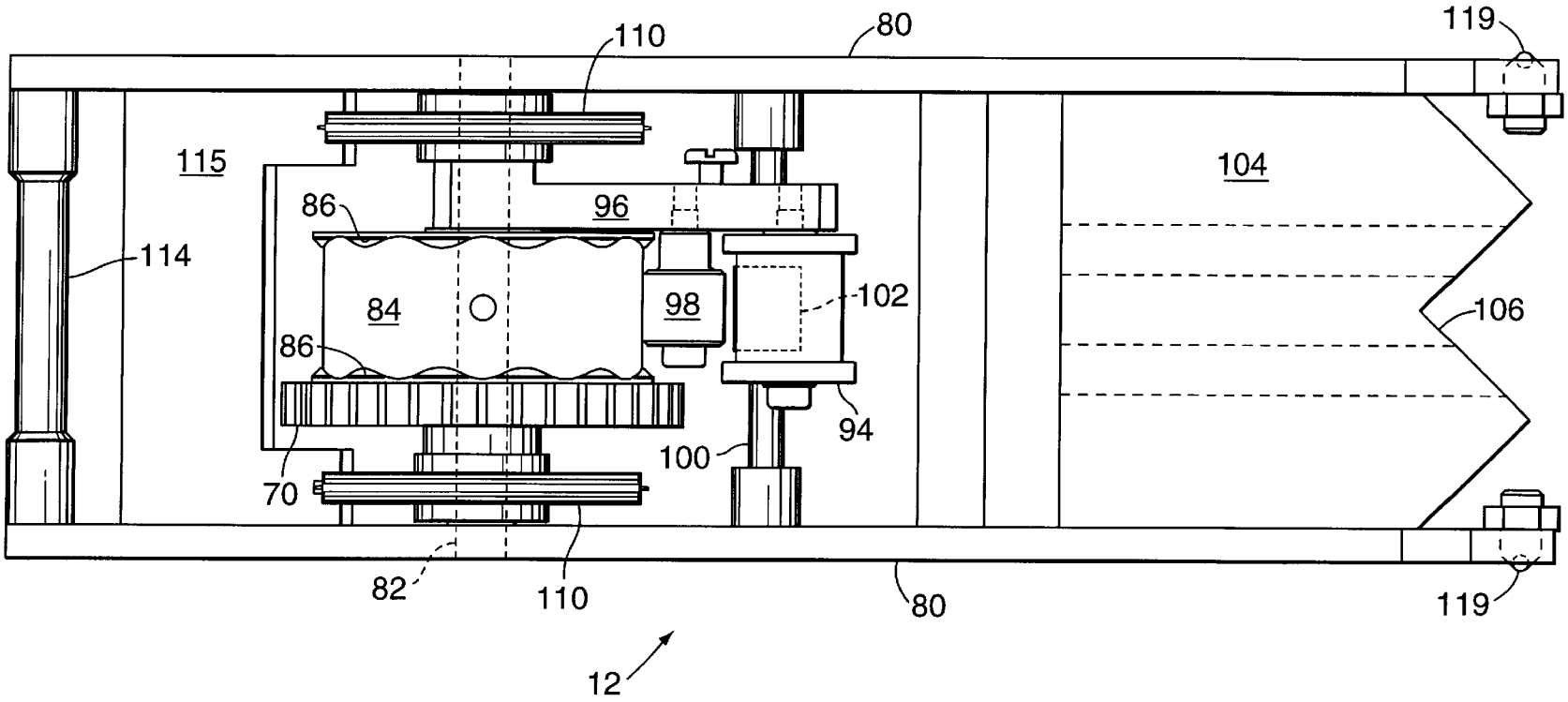

FIG. 5. is an elevational end view of the labeler shown in FIG. 1;

FIG. 6 is a top plan view of a portion of the labeler shown in FIG. 1 showing the bellows wheel;

FIG. 7 is a side elevational view of the label cassette for the labeler of FIG. 1;

FIG. 8 is a top plan view of the label cassette shown in FIG. 7; and

Figure 9:
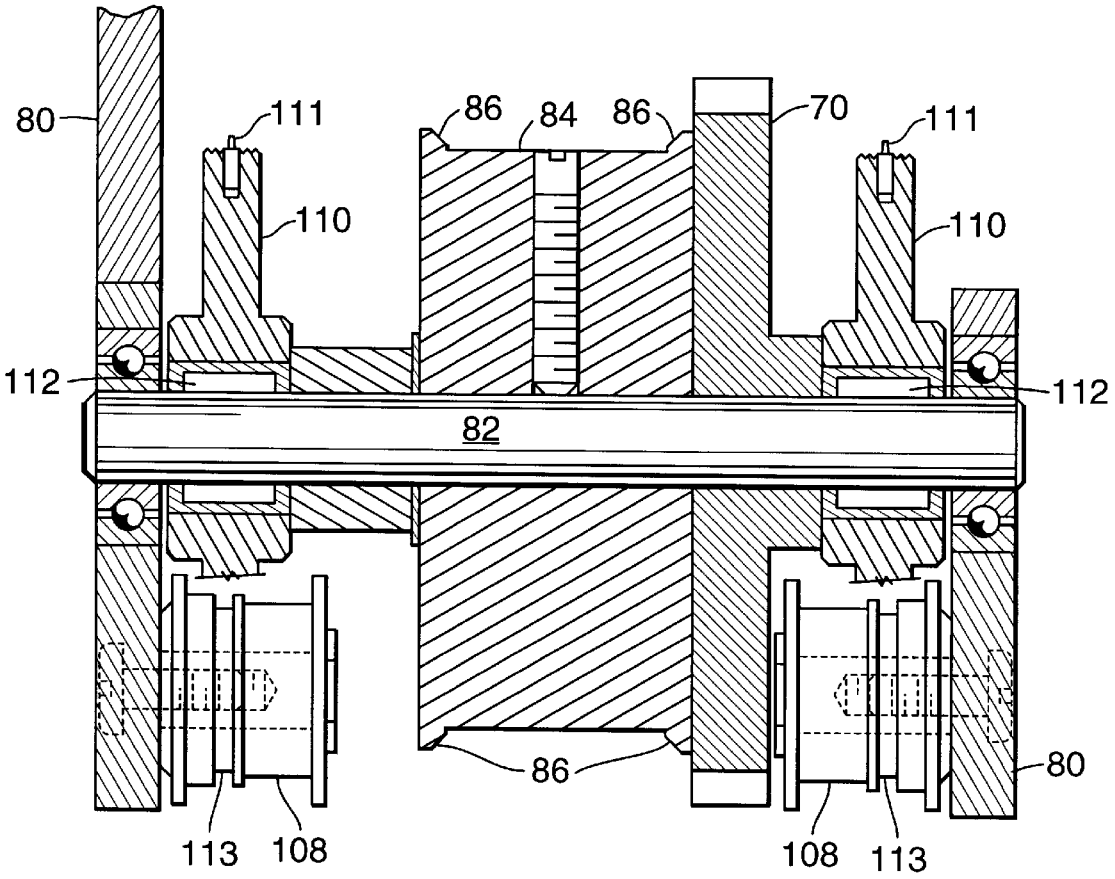

FIG. 9 is a cross sectional view taken on line 9—9 of FIG. 7.

Figure 3:
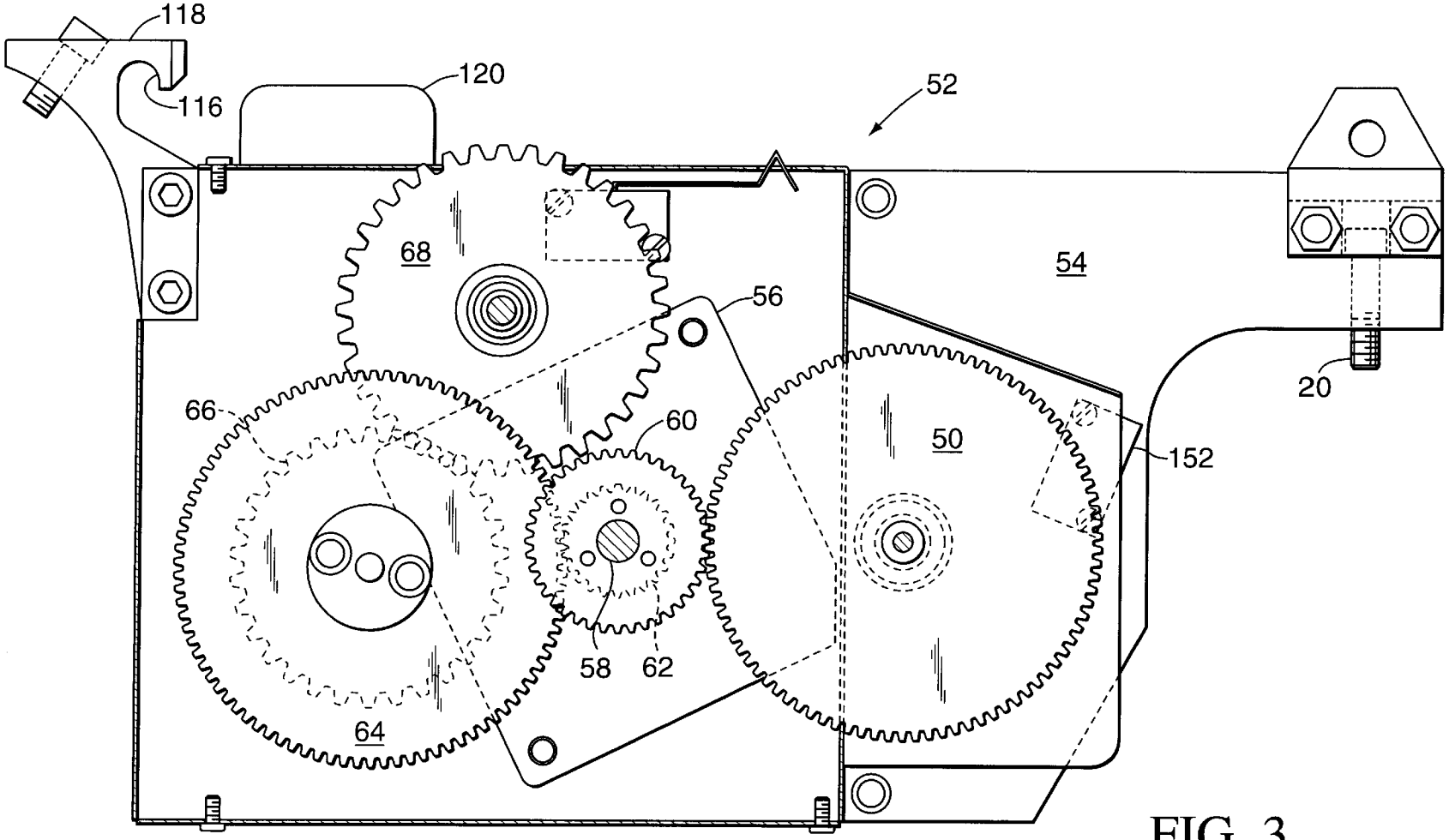
FIG. 3 is a side elevational view, partly in section with parts broken away and eliminated, of the drive train for the labeler of FIG. 1.
Figure 4:
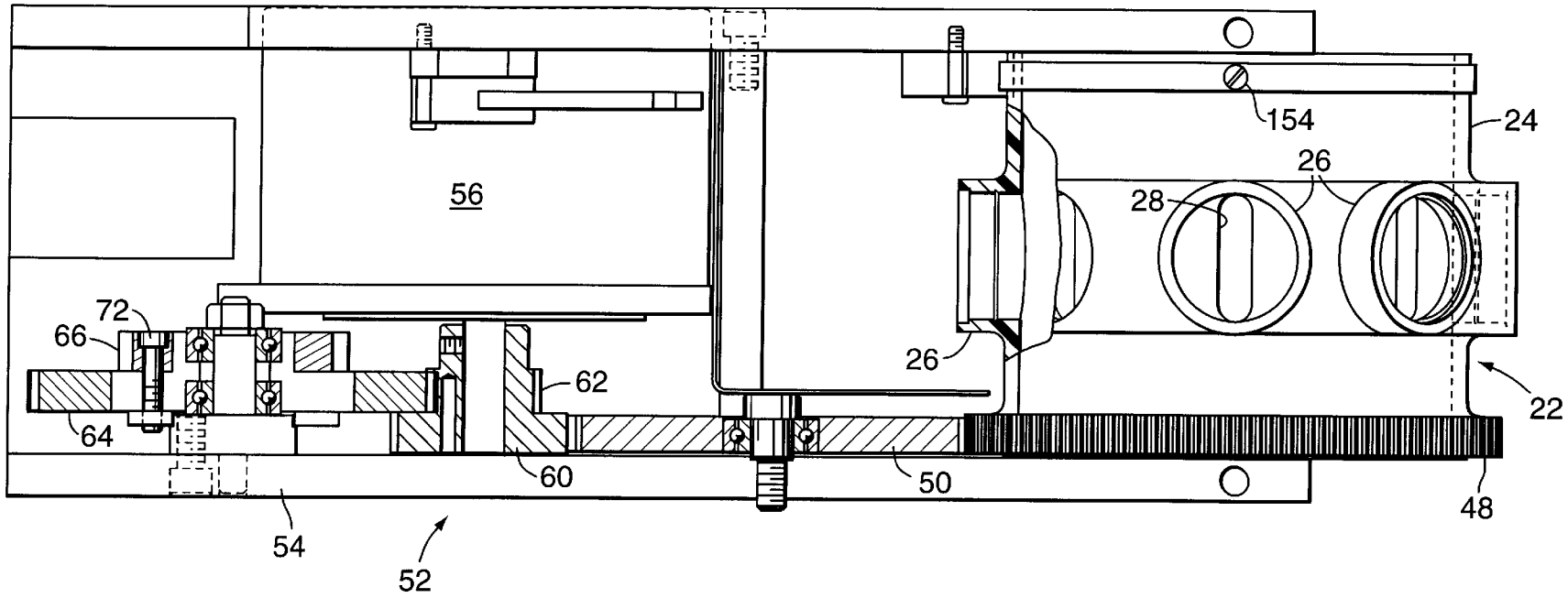
FIG. 4 is a top plan view, partly in section, of the labeler shown in FIG. 1 with the label cassette removed.

Referring now to FIG. 1, there is shown a labeler, indicated generally at 10, with a label cassette 12 in engagement therewith, supported over a conveyor 14 having conventional cradles for holding and positioning individual fruit 16. The means of such support is through attachment to a vacuum tube 18 by bolts 20 as can be seen in FIG. 3. As best seen from FIGS. 4 and 6, a bellows wheel 22 includes a tubular portion 24 which is rotatable on and sealingly engageable on its ends with the vacuum tube 18. Eight cylindrical projections 26 are provided around the periphery of the tubular member 24 and are positioned with their centers spaced 45 degrees from each other. Each of the cylindrical projections 26 is provided with slot 28 to permit communication with the tube 18, which tube is provided with a plurality of equally spaced radial holes 30 and is connected with a vacuum source. For ease of manufacture, the vacuum tube 18 is composed of multiple sections joined together and suspended from a pressure tube 32 extending along the interior of the vacuum tube 18. The suspension is by means of bolts 33 extending though the vacuum tube 18 and engaging tapped holes in the pressure tube 32, with spacers 35 maintaining the proper distance between the two tubes 18 and 32. The pressure tube 32 is connected to a source of air pressure, which may be a conventional blower. For convenience and economy, the source of vacuum for the tube 18 may be the inlet side of the blower supplying air pressure to the tube 32. A cross tube 34 is connected, and communicates air pressure, between the pressure tube 32 and a slot 36 in the vacuum tube 18 at the six o'clock position. The width of the slots 28 in the projections is wider than the space between the holes 30 so that vacuum is always available to each projection 26, except when the projection is at the six o'clock position. As the slot 28 for each projection 26 rotationally approaches that position, vacuum access is interrupted and communication with the pressure slot 36 is initiated. Similarly, as each projection rotationally leaves the 6 o'clock position, pressure is cut-off just before access to vacuum is permitted. The purpose of this arrangement for vacuum and pressure is to control the timing for extension and retraction of a flexible bellows 38 provided for each of the projections 26.

Each of the bellows 38 is retained by a outward projecting flange 40 on a relatively rigid cup 42 having a slotted end for insertion into a cylindrical projection 26. A lip formed on the slotted end snaps into an internal groove in the projection 26 to releaseably retain the cup 42 in place. Holes in the outer end of the cup 42 communicate pressure or vacuum in the projection 26 to the associated bellows 38. Holes in the end of the bellows are covered by a flexible flap to permit air flow into the bellows when vacuum is present in the projection 26 and to seal the bellows holes when air pressure is present. The cup 42 also functions to limit the amount of collapse for the associated bellows when subjected to vacuum. Thus, the bellows 38 are contracted throughout the rotation of the tubular member 24 except when in proximity to the six o'clock position. It is in that position that each of the bellows is extended toward the fruit to effect the application of a label thereto.

The bellows wheel 22 is intermittently rotated by a gear 48 formed on one end of the tubular member 24, which gear meshes with a bellows drive gear 50. A drive assembly, indicated generally at 52, which includes a housing 54 in which the gear 50 is rotatably mounted. A stepper motor 56 is mounted within the housing 54 and has an output shaft 58 with a drive gear 60 attached thereto, which gear 60 meshes with the bellows drive gear 50. A second drive gear 62 is also attached to the output shaft 58 and meshes with an idler gear 64 rotatably mounted in the housing 54. An idler sprocket 66 is attached to the idler gear 64 and meshes with a cassette drive sprocket 68. The sprocket 68 is rotatably mounted in the housing 54 with its teeth projecting through and above a protective cover secured to the top of the housing to engage the sprocket 70 carried by the cassette 12. In order to accommodate labels of different sizes, the sprocket 66 is removably secured to the gear 64 by bolts 72 so that a sprocket with the number of teeth necessary to advance the label carrier the proper distance may be installed.

The stepper motor 56 is mounted in the housing so that its output shaft 58 is between the rotational mountings of the bellows drive gear 50 and the idler gear 64 and idler sprocket 66, and the rotational mounting of the cassette sprocket is above and between the output shaft and the rotational mountings of the idler gear 64 and idler sprocket 66. This arrangement produces a compact footprint for the labeler 10.

As shown in FIGS. 1 and 7–9, the cassette 12 has a frame 80 with a shaft 82 rotatably mounted therein. The cassette sprocket 70 is affixed to the shaft 82 as is a hub 84 which is centered on the frame. The hub 84 has a depressed center section with sinusoidal side walls 86 projecting toward and away from each other. The edges of the carrier 88 are formed with a shape complementary to and engageable with the sinusoidal side walls 86. The carrier 88 is wound on a shaft 90 which is rotatably supported on handles 92 formed on and extending upward from the frame 80. The carrier 88 is trained around a guide pulley 94 rotatably carried on a tension arm 96 which is loosely carried by the shaft 82. A second roller 98 rotatably carried by the arm 96 assures the carrier 88 engages the side walls 86. A stepped shaft 100 extends across and is non-rotationally secured to the frame 80. A full diameter section 102 of the shaft 100 is engageable by the guide roller 94 to assure the carrier remains within the side walls thereof. The full diameter section 102 also limits the downward travel of the guide roller 94, which is biased downward by gravity, to trap the carrier 88 therebetween and arrest the carrier's momentum and to maintain tension therein.

A plate 104 having a V-shaped notch 106 is attached to the frame 80 to split the carrier 88, which is weakened along its centerline for that purpose, and to separate the labels from the carrier as the carrier passes over the notch 106. Each half of the separated carrier passes underneath the plate 104 and around guide rollers 108 rotatably mounted by shaft 109 on the frame 80. Each half passes between the rollers 108 and pin wheels 110, passing over the top of the pin wheels 110, which are rotated in a counter-clockwise direction as viewed in FIG. 7. The pin wheels 110 are provided with protruding sharp pins 111 which penetrate the associated half of the carrier, the penetration being aided by a groove 113 in the guide rollers 108. Each of the pin wheels 110 is mounted by conventional roller clutches 112 on the shaft 82. The clutches 112 permit the pin wheels to free-wheel in a counter-clock wise direction as viewed in FIG. 7, which is the direction the shaft 82 rotates when it is being driven, but do not permit rotation of the pin wheels in a clockwise direction so that tension is maintained on each half of the carrier 88 without causing separation thereof. A wedge 115 secured to the inside of each side of the frame 80 separates the halves of the carrier 88 from the pins 111 on the associated pin wheel 110.

A bar 114 spans one end of the frame 80 and is engageable with a hook 116 formed in the bracket 118. (See FIG. 3) The bracket 118 is secured to the housing 54 of the drive assembly 52. The bar 114 has enlarged diameter ends, the transitions to which tends to center the bar 114 on the bracket 118 and the drive assembly 52 as the bar 114 is positioned under the hook 116, as do the guides 120 formed on the top cover for the frame 54. A spring-loaded detent 119 is mounted on each side of the cassette frame 80 and engages a recess on the frame 54 to releaseably retain the cassette in place on the drive assembly. (See FIGS. 6 & 8) The cassettes are interchangeable so that one cassette can be loaded off-line with a reel of a carrier bearing labels while another cassette is operatively engaged with the labeler 10 to apply labels to the fruit.

The stepper motor 56 is activated or energized for rotation of its output shaft 58 by a fruit sensing switch 150 positioned beside the conveyor 14 to detect the approach of a fruit in a cradle on the conveyor. Once energized, the stepper motor 56 accelerates from standstill to a rotational speed which causes the velocity of the end of the bellows 38 to match that of the conveyor 14, which may be determined by counting the rotations of an idler sprocket (not shown) engaging the conveyor, and then decelerates to standstill. The acceleration or ramp-up of the motor 56 from standstill, which is initiated by closing of sensing switch 150, is a function of the speed of the conveyor 14, the distance between the cradles thereon carrying the fruit, and the maximum tensile force to which the carrier 88 may be subjected. A proximity switch 152 mounted on the frame 54 detects the head of a plurality of small metal screw 154 secured to the bellows wheel 22, with each screw 154 being positioned adjacent one of the projections 26. The deceleration or ramp-down is initiated by the proximity switch 152 closing upon the approach of the next head of screw 154 and is a mirror image of the acceleration.

Activation of the motor 56 causes the gears 60 and 62 to be rotated in a clockwise direction as viewed in FIG. 3, which results in both the bellows wheel 22 and the cassette drive sprocket 68 being driven in the same direction. Because there is a direct connection between the drive of both the bellows wheel and the cassette, a full bellows cycle, i.e. the full 45 degrees between individual bellows, is available to effect the transfer of a label from the carrier to the end of an individual bellows. As a consequence, lower velocities of tape speeds are required and the transfer of labels to the ends of the individual bellows is more reliable, with fewer labels missing and with greater accuracy of placement. Additionally, the labeler is capable of higher speeds, because each individual bellows need move through an arc of only 45 degrees, rather than 60 degrees as required by the prior art.

While a preferred embodiment of the present invention has been illustrated and described herein, it is to be understood that various changes may be made without departing from the spirit of the invention as defined by the scope of the appended claims.

What is claimed is:

1. An labeler comprising:

a housing;

a bellows drive gear and a cassette drive sprocket spaced apart and each rotatably supported in said housing;

a stepper motor mounted in said housing and having an output shaft;

a first drive gear affixed to said shaft and engaging said bellows drive gear;

a second drive gear affixed to said shaft;

a drive train interposed between and engaging said second gear and said cassette drive sprocket; and said stepper motor is positioned between said bellows drive gear and said cassette drive sprocket whereby the footprint of the labeler is minimized.

2. The invention according to claim 1 wherein said drive train comprises:

an idler gear rotatably mounted in said housing and engaging said second gear;

an idler sprocket attached to said idler gear and engaging said cassette sprocket; and said cassette sprocket is positioned above and between said first drive gear and said idler sprocket.

3. The invention according to claim 2 wherein said idler sprocket is removeably attached to said idler gear to permit replacement with idler sprockets of different pitches to accommodate labels of different sizes.

4. The invention according to claim 1, and further comprising a bellows wheel having a gear formed thereon engaging said bellows drive gear.

5. The invention according to claim 4 wherein said bellows wheel is provide with eight individual bellows spaced therearound.

6. The invention according to claim 4 wherein said bellows wheel has individual bellows arranged 45 degrees apart around the periphery thereof.

7. The invention according to claim 6 and further comprising:

a marker for each of the individual bellows;

a position sensor for detecting each of said markers;

a fruit sensor for detecting the fruit; and means connected to said motor to advance the bellows wheel 45° after the fruit sensor has detected fruit.

8. The invention according to claim 7 wherein said motor simultaneously advances the cassette drive sprocket to position a label over the individual bellows positioned at twelve o'clock.

9. The invention according to claim 8 and further comprising: pressure means for applying air pressure to each of said individual bellows in and adjacent its six o'clock position; and vacuum means for otherwise subjecting each of said individual bellows to vacuum.

10. The invention according to claim 9 wherein:

said pressure means includes a structural tube communicating with a source of air under pressure;

said vacuum means includes an outer tube surrounding and secured to said structural tube; and said bellows wheel is rotatably mounted on said outer tube.

11. A labeler for applying labels on a carrier to fruit transported by a conveyor comprising:

a housing;

a label feed means;

a rotatable bellows wheel having individual bellows spaced at 45° around the periphery thereof;

each of said individual bellows being subjected to pressure when adjacent its six o'clock position, but otherwise subjected to vacuum; and drive means simultaneously to advance said label feed means and to rotate said bellows wheel 45° to effect deposit of a label on the individual bellows at the twelve o'clock position and the application of a label to fruit by the individual bellows at the six o'clock position, wherein said drive means comprises:

a bellows drive gear and a cassette drive sprocket spaced apart and rotatable mounted on the housing;

a stepper motor positioned between the bellows drive gear and the cassette drive sprocket and having an output shaft; and means interconnecting said output shaft to said bellows drive gear and cassette drive sprocket.

12. The invention according to claim 11 wherein a full bellows cycle corresponding to a 45° rotation of the bellows wheel is available to transfer the label from a carrier of labels to each of said individual bellows.

13. The invention according to claim 11 and further comprising means to accelerate said motor to velocity such that the outer end of the individual bellows matches the speed of said conveyor.

14. A labeler for applying labels on a carrier to fruit transported by a conveyor comprising:

a housing:

a label feed means;

a rotatable bellows wheel having individual bellows spaced at 45° around the periphery thereof;

drive means capable of simultaneously advancing said label feed means and rotating said bellows wheel 45° to effect deposit of a label on the individual bellows at the twelve o'clock position whereby a full cycle corresponding to a 45° rotation of the bellows wheel is available to effect the transfer of a label to each of the individual bellows, wherein said drive means comprises:

a bellows drive gear and a cassette drive sprocket spaced apart and rotatable mounted on the housing;

a stepper motor positioned between the bellows drive gear and the cassette drive sprocket and having an output shaft; and means interconnecting said output shaft to said bellows drive gear and cassette drive sprocket.

15. A labeler capable of high speed application to fruit of labels on a carrier comprising:

a housing;

a label feed means for advancing a carrier and separating labels therefrom;

a rotatable bellows wheel having individual bellows spaced at 45° around the periphery thereof and capable of receiving a separated label; and drive means for simultaneously driving both said bellows wheel and said feed means so that for every movement of said bellows wheel through an arc of 45° a separated label is received by one of said individual bellows and a label is applied to a fruit by opposite positioned individual bellows, wherein said drive means comprises:

a bellows drive gear and a cassette drive sprocket spaced apart and rotatable mounted on the housing;

a stepper motor positioned between the bellows drive gear and the cassette drive sprocket and having an output shaft; and means interconnecting said output shaft to said bellows drive gear and cassette drive sprocket.

* * * * *